US006235444B1

(12) United States Patent
Nagai et al.

(10) Patent No.: US 6,235,444 B1
(45) Date of Patent: May 22, 2001

(54) TONER FOR DEVELOPING ELECTROSTATIC LATENT IMAGE AND MANUFACTURING METHOD THEREOF

(75) Inventors: Yasuki Nagai, Kobe; Junji Machida, Toyonaka; Yuji Shintani, Takarazuka; Mitsutoshi Nakamura, Kawanishi, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/477,370

(22) Filed: Jan. 4, 2000

(30) Foreign Application Priority Data

Jan. 21, 1999 (JP) ..... 11-012938

(51) Int. Cl.[7] ..... G03G 9/08
(52) U.S. Cl. ..... 430/137; 430/109; 430/111
(58) Field of Search ..... 430/137, 111, 430/109

(56) References Cited

U.S. PATENT DOCUMENTS

| | | | | |
|---|---|---|---|---|
| 5,290,654 | * | 3/1994 | Sacripante et al. | 430/137 |
| 5,547,794 | | 8/1996 | Demizu et al. | 430/106 |
| 5,604,067 | | 2/1997 | Nagai et al. | 430/106.6 |
| 5,620,826 | | 4/1997 | Tavernier et al. | 430/137 |
| 5,622,802 | | 4/1997 | Demizu et al. | 430/106 |
| 5,650,256 | * | 7/1997 | Veregin et al. | 430/137 |
| 5,885,743 | | 3/1999 | Takayanagi et al. | 430/110 |
| 5,985,501 | * | 11/1999 | Sato et al. | 430/137 |
| 6,110,636 | * | 8/2000 | Foucher et al. | 430/137 |

* cited by examiner

*Primary Examiner*—Janis L. Dote
(74) *Attorney, Agent, or Firm*—Burns, Doane, Swecker & Mathis, LLP

(57) ABSTRACT

The present invention relates to toner comprising a binder resin and a colorant, wherein the toner is manufactured by a wet-type granulation method using an organic dispersing agent, an aqueous extract liquid having a surface tension of 50 to 72 mN/m at 25° C., the aqueous extract liquid obtained by mixing 1 part-by-weight toner and 50 parts-by-weight distilled water for 1 hour at 80° C.

18 Claims, No Drawings

TONER FOR DEVELOPING ELECTROSTATIC LATENT IMAGE AND MANUFACTURING METHOD THEREOF

RELATED APPLICATIONS

The present application is based on Patent Application No. 11-12938 filed in Japan, the content of which is hereby incorporated by reference.

BACKGROUND OF THE INVENTION

1. Field of the Invention

The present invention relates to an electrostatic latent image developing toner and a manufacturing method thereof. The toner is used to develop an electrostatic latent image in electronic photography, electrostatic recording, and electrostatic printing.

2. Description of the Related Art

In recent years, the manufacturing of toner particles using granulation methods among the wet-type methods represented by emulsion dispersion methods, suspension polymerization methods, and emulsion polymerization methods have become a focus of attention from the perspectives of reducing manufacturing costs while achieving high quality images.

Emulsion dispersion methods involve dissolving or dispersing binder resin and colorant in a suitable organic solvent to obtain a color resin solution, adding this solution to an aqueous liquid medium, and vigorously mixing the fluid to form droplets of resin solution. This material is then heated, to remove the organic solvent from the droplets to achieve granulation.

Suspension polymerization methods involve suspending polymerizable components which comprises polymerizable monomer, and polymerization initiator, colorant and other additive added as necessary in a dispersion medium to form oil droplet dispersion particles, polymerizing the monomer to form colored resin particles (toner particles).

Emulsion polymerization methods involve adding a nearly water insoluble polymerization monomer in water and attaining an emulsion state, then accomplishing granulation by polymerization using a water soluble polymerization initiator. Generally, colorant, charge control agent and the like are added post polymerization and after the particles are formed.

The dispersants used in wet-type granulation include inorganic dispersion agents and organic dispersing agents. Tribasic calcium phosphate is generally used as an inorganic dispersing agent. Since tribasic calcium phosphate effectively produces a pH of 10 to 14 in water, polyester resin is hydrolyzed by these components due to the alkalinity resistance required by the toner particles so as to cause problem at low melt temperatures and the like, and charge controllers which do not have alkalinity resistance disadvantageously loose functionality. For this reason these aspects must be considered when selecting materials, which greatly restricts the materials which can be selected for the toner. Manufacturing conditions also must be controlled because the toner component dispersion density markedly changes particle size and shape depending on the granulation conditions such as oil-in-water (O/W) emulsions and the like.

Toner manufactured by wet-type granulation methods such as emulsion dispersion, suspension polymerization, and emulsion polymerization using organic dispersing agent disadvantageously produce chargeability problems, e.g., generation of inadequately charged particles and many reverse charge toner particles. In particular, chargeability may be greatly reduced or fluctuate due to environmental conditions. This tendency may become pronounced under high temperature, high humidity conditions.

Wet-type granulation methods generally add dispersing agent or emulsifier, but the dispersing agent or emulsifier used for suspension or emulsification is removed by washing in water after granulation.

Conventionally, however, residual dispersing agent and the like adhered to the surface of the toner particles is not completely removed simply by washing in water, and this residual material on the surface of the toner may be a factor affecting toner chargeability. Various proposals have been offered to eliminate the previously described disadvantages, but none have adequately resolved these disadvantages with organic dispersing agents are used.

SUMMARY OF THE PRESENT INVENTION

An object of the present invention is to provide a toner having excellent chargeability and environmental stability, and is manufactured by a wet-type granulation method using organic dispersing agent.

The present invention relates to toner comprising a binder resin and a colorant, wherein the toner is manufactured by a wet-type granulation method using an organic dispersing agent, an aqueous extract liquid having a surface tension of 50 to 72 mN/m at 25° C., the aqueous extract liquid obtained by mixing 1 part-by-weight toner and 50 parts-by-weight distilled water for 1 hour at 80° C.

DESCRIPTION OF THE PREFERRED EMBODIMENTS

In the present invention, a wet-type granulation is first accomplished. The wet-type granulation method used to produce toner particles may be, for example, an emulsion dispersion method.

In the emulsion dispersion method, granulation is accomplished by dissolving or dispersing a binder resin, colorant, and other additives as necessary in a non-water-soluble organic solvent to obtain a color resin fluid, which is then subjected to emulsion dispersion in an aqueous liquid medium to form an oil-in-water (O/W) type emulsion, from which the non-water soluble organic solvent is subsequently removed. O/W emulsion indicates a suspension fluid, wherein an oil-based liquid is dispersed as droplets in an aqueous liquid medium. Furthermore, when obtaining the O/W emulsion dispersion, the resin solution is not added all at once, but desirably is added by gradual titration. In this way the toner of the present invention is readily obtained.

The binder resin used in the emulsion dispersion method is not specifically limited insofar as the binder resin is soluble in a water-insoluble organic solvent described later, and insoluble or nearly insoluble in water. Examples of useful binder resins include styrene resin, (meth)acrylic resin, styrene-(meth)acrylic copolymer resin, olefin resin, polyester resin, polyamide resin, polycarbonate resin, polyether resin, polyvinylacetate resin, polysulfone resin, epoxyresin, polyurethane resin, urea resin and like well-known types of resins used individually or in combinations of two or more.

It is desirable that the binder resin has a glass transition temperature (Tg) of 50 to 70° C., a number-average molecular weight (Mn) of 1,000 to 50,000, and more desirably 3,000 to 20,000, and a molecular weight distribution (Mw/Mn) representing the ratio of Mn and the weight-average molecular weight (Mw) of 2 to 60. When the toner of the present invention is used as an oil application fixing toner, it is desirable that the ratio Mw/Mn is 2 to 5, and when used as an oilless fixing toner, it is desirable that the ratio Mw/Mn is 20 to 50.

The organic solvent used for dissolving the binder resin is insoluble or nearly insoluble in water, and will dissolve the previously listed binder resins. Examples of useful organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methylethylketone, methylisobutylketone and the like used individually or in combinations of two or more. Particularly desirable are aromatic solvents such as toluene and xylene and the like, and halogenated hydrocarbons such as methylene chloride, 1,2-dichloroethane, chloroform, carbon tetrachloride and the like.

Organic and inorganic types of pigment of various colors as listed below may be used as the colorant included in the toner of the present invention. Examples of useful black pigments include carbon black, copper oxide, manganese dioxide, aniline black, activated charcoal, nonmagnetic ferrite, magnetic ferrite, magnetite and the like.

Examples of useful yellow pigments include chrome yellow, cadmium yellow, yellow oxide, mineral fast yellow, nickel titanium yellow, naval yellow, naphthol yellow S, Hansa yellow G, Hansa yellow 10G, benzidine yellow G, benzidine yellow GR, quinoline yellow lake, permanent yellow XCG, tartrazine lake and the like.

Examples of useful orange color pigments include chrome orange, molybdenum orange, permanent orange GTR, pyrazolone orange, vulcan orange, indathrene brilliant orange RK, benzidine orange G, indathrene brilliant orange GK and the like.

Examples of useful red pigments include red oxide, cadmium red, red lead, mercury thiocyanate, cadmium, permanent red 4R, lithol red, pyrazolone red, Watchung red, calcium salt, lake red C, lake red D, brilliant carmine 6B, eosine lake, rhodamine lake B, alizarin lake, brilliant carmine 3B and the like.

Examples of useful purple pigments include manganese violet, fast violet B, methyl violet and the like.

Examples of useful blue pigments include Prussian blue, cobalt blue, alkali blue lake, victoria blue lake, phthalocyanine blue, nonmetallic phthalocyanine blue, partially chlorinated phthalocyanine blue, fast sky blue, indathrene blue BC and the like.

Examples of useful green pigments include chrome green, chrome oxide, pigment green B, micalite green lake, final yellow-green G and the like.

Examples of useful white pigments include zinc oxide, titanium oxide, antimony oxide, zinc sulfide, calcium carbonate, tin oxide and the like.

Examples of useful extender pigments include pearlite powder, barium carbonate, clay, silica, white carbon, talc, alumina white and the like.

These colorants may be used individually or several may be combined. The colorant is used at a rate of 1 to 20 pbw (parts-by-weight), and desirably 2 to 15 pbw relative to 100 pbw of binder resin. When colorant is added in excess of 20 pbw, the toner fixing characteristics are impaired, and when less than 1 pbw is added, there is concern that a desired image density cannot be obtained.

In addition to the aforesaid binder resin and colorant, other components may be added as necessary to the toner of the present invention, e.g., charge controller, magnetic powder, anti-offset agent and the like.

There are various types of charge controllers, which are materials that impart a positive or a negative charge via triboelectric charging. Examples of positive charge controllers include nigrosine dyes such as nigrosine base EX™ (Orient Chemical Industries, Ltd.) and the like, quaternary ammonium salts such as COPY CHARGE PX VP435™ (Hoechst, Inc.) and the like, and imidazole compounds such as alkoxidated amine, alkyl amide, molybdate chelate pigment, PLZ1001™ (Shikoku Chemical Corp.) and the like.

Examples of useful negative charge controllers include metal complexes such as BONTRON S-22™ (Orient Chemical Industries, Ltd.), BONTRON S-34™ (Orient Chemical Industries, Ltd.), BONTRON E-81™ (Orient Chemical Industries, Ltd.), BONTRON E-84™ (Orient Chemical Industries, Ltd.), SPIRON BLACK TRH™ (Hodogaya Chemical Industries, Ltd.) and the like, quaternary ammonium salts such as thioindigo pigment, COPY CHARGE NX VP434™ (Hoechst, Inc.) and the like, calix arene compounds such as BONTRON E-89™ (Orient Chemical Industries, Ltd.) and the like, and fluorine compounds such as magnesium fluoride, carbon fluoride and the like. Metal complexes used as negative charge controllers include, in addition to those previously mentioned above, oxycarboxylic acid metal complexes, dicarboxylic acid metal complexes, amino acid metal complexes, benzene containing azo radicals-naphthalene derivative structural metal complexes and the like.

Examples of useful magnetic powder include magnetite, γ-hematite, or various types of ferrites.

Examples of useful anti-offset agents include various types of wax, particularly low molecular weight polypropylene, polyethylene, or polyolefin waxes such as oxidized polypropylene, polyethylene and the like.

Devices which may be used to dissolve or disperse binder resin, colorant, and other toner components in water-insoluble organic solvent include ball mill, sand grinder, homomixer, ultrasonic homogenizer and the like.

The solid content density in the color resin solution obtained by dissolving or dispersing binder resin, colorant, and other additives in a water-insoluble organic solvent must be set such that the droplets readily solidify on the microparticles when the water-insoluble organic solvent is removed from the droplets by heating the O/W emulsion obtained by emulsion dispersion of the color resin solution in an aqueous liquid medium, and this solid content density is set at 5 to 50% by weight, and desirably set at 10 to 40% by weight.

The O/W emulsion may be formed using a method which adequately mixes a mixed system of a color resin solution and an aqueous liquid medium using a mixing device such as a homomixer or the like. It is desirable that the mixing time is more than 10 min so as to not obtain a sharp particle size distribution as occurs when the mixing time is too short.

The ratio (Vp/Vw) of the color resin solution volume (Vp) and the aqueous liquid medium volume (Vw) is $Vp/Vw \leqq 1$, and desirably $0.3 \leqq Vp/Vw \leqq 0.7$. When the ratio $Vp/Vw > 1$ obtains, a stable O/W emulsion cannot be formed, and there is great concern that phase transition occurring during formation will form a W/O-type emulsion.

The aqueous liquid medium used in forming the O/W emulsion may be water, or contain a water soluble organic solvent to the degree it does not destroy the emulsion in water, e.g., water/methanol mixed solution (weight ratio:

50/50 to 100/0), water/ethanol mixed solution (weight ratio: 50/50 to 100/0), water/acetone mixed solution (weight ratio: 50/50 to 100/0), water/methylethylketone mixed solution (weight ratio: 70/30 to 100/0) and the like.

Organic dispersing agents and dispersion-aiding agent may be added as necessary to the aqueous liquid medium. Examples of useful organic dispersing agents include nonionic organic dispersing agents such as polyvinyl alcohol, carboxymethyl cellulose and the like, and anionic organic dispersing agents such as sodium polyacrylate, sodium polymethacrylate, sodium polymalenate, sodium acrylate-malenate copolymer or sodium polystyrene-sulfonate and the like, or cationic organic dispersing agents such as quaternary ammonium salts and the like. Among the aforesaid materials, the nonionic organic dispersing agents and anionic organic dispersing agents are recommended for the present invention.

The organic dispersing agent may be used in normal quantity, for example, organic dispersing agent may be added in a range of approximately 1 to 10% by weight relative to the aqueous liquid medium (water+aqueous organic solvent).

Organic dispersion-aiding agents and inorganic dispersion-aiding agents may be used as desired. Examples of useful organic dispersion-aiding agents include anionic surfactant, cationic surfactant, and nonionic surfactant. When a nonionic organic dispersing agent is used, it is desirable to use an anionic surfactant or nonionic surfactant as a dispersion-aiding agent. When an anionic organic dispersing agent is used, it is desirable to use an anionic surfactant as a dispersion-aiding agent. When a cationic organic dispersing agent is used, it is desirable to use a cationic surfactant as a dispersion-aiding agent.

Usable methods for removing the water-insoluble organic solvent from the O/W emulsion include methods which gradually raise the temperature of the entire system to completely evaporate the water-insoluble organic solvent in the droplets, and methods which spray the O/W emulsion within a dry atmosphere to completely remove the water-insoluble organic solvent in the droplets and form toner microparticles, then evaporate the aqueous dispersant.

A strong point of emulsion dispersion methods is that many types of resins may be used compared to suspension polymerization methods and the like.

Granulation methods which include a polymerization process also may be used as a wet-type toner particle granulation method. Examples of such useful methods include suspension polymerization, emulsion polymerization, soap-free emulsion polymerization, microcapsulation (surface polymerization, in-situ polymerization and the like), non-aqueous dispersion polymerization and the like.

In suspension polymerization methods, polymerizable components comprising polymerizable monomer, polymerization initiator, colorant and other additive (charge controller, magnetic powder, anti-offset agent etc.) added as necessary are suspended in a dispersion medium to form oil droplet dispersion particles. Granulation is accomplished by heating to induce polymerization.

Examples of useful polymerizable monomers for use in suspension polymerization include styrene monomers such as styrene, methylstyrene, methoxystyrene, butylstyrene, phenylstyrene, ethylstyrene, chlorostyrene and the like, acrylate monomer or methacrylate monomers such as methylacrylate, ethylacrylate, propylacrylate, butylacrylate, dodecylacrylate, stearylacrylate, ethylhexylacrylate, acrylamide, methylmethacrylate, ethylmethacrylate, propylmethacrylate, butylmethacrylate, octylmethacrylate, dodecylmethacrylate, ethylhexylmethacrylate, stearylmethacrylate and the like, ethylene, propylene, butylene, vinylchloride, vinylacetate, acrylonitrile and the like. These materials may be used individually or in several in combination. These materials also may be used to form prepolymers.

Examples of useful polymerization initiator for use in suspension polymerization include peroxide initiators such as penzoyl oxide, lauroyl peroxide, stearyl peroxide and the like, and azo-bis initiators such as 2,2'-azobisisobutylonitrile, 2,2'-azobis-(2,4-dimethylvaleronitrile and the like.

When forming oil droplet dispersion particles in a polymer constituent suspension in a dispersion medium, the material should be vigorously mixed using a high-speed mixing type dispersion apparatus such as a homomixer, homogenizer or the like.

When accomplishing polymerization, the solution system of the dispersed polymerization constituents may be set at an optional temperature above the decomposition temperature of the polymerization initiator; a temperature of 40 to 150° C. is normally desirable.

Dispersion stabilizer may be added to the dispersion medium to prevent re-agglomeration of the dispersed particles. Usable dispersion stabilizer is identical to those used in the previously described emulsion dispersion method.

In the suspension polymerization method, it is necessary to suppress as far as possible residual monomer within the resin microparticles. When there is excessive residual monomer, agglomeration occurs when removing the dispersion stabilizer by washing, the toner develops an odor, toner chargeability becomes unstable, and softening temperature dispersion also results. In order to suppress residual monomer, it is desirable to use a multi-stage polymerization method wherein polymerization occurs at low temperature (10 to 80° C.) during the first half of the reaction, and polymerization occurs at high temperature (80 to 150° C.) during the latter half of the reaction, and it is further desirable that a prepolymer is used.

In the present invention, the resin particle, granulated by a wet-method is washed by adding 1 pbw toner to 50 pbw distilled water and mixing while the temperature is raised to obtain an aqueous extract liquid having a surface tension of 50 to 72 mN/m at 25° C. More specifically, 1 pbw toner is added to 50 pbw distilled water in a 100 cc beaker, and heated to 80° C. and mixed for 1 hr using a stirrer tip speed of 120 rpm, and the resultant solution is cooled, then centrifuged and filtered using a 0.3 $\mu$m mesh filter to separate solid matter, such that the aqueous impurity extract liquid has a surface tension of 50 to 72 mN/m at 25° C. The greater the surface tension of the extract fluid, the more efficient the washing of the aqueous impurities, such as the organic dispersing agent used during wet-type granulation, from the surface of the toner particles. When the surface tension of the extract fluid is 72 mN/n, the aqueous dispersant and the like adhered to the toner surface is washed away with nearly 100% efficiency because the surface tension value is near the surface tension of pure water.

In the case of toner previously subjected to post-processing with hydrophobic silica, titania and the like, 1 g of toner is added to 20 g of 50 wt % methanol-water solution, and mixed until thoroughly moistened, and thereafter 40 g distilled water is added, and the solution is heated to 80° C. while mixing and the system is left open for 1 hr while maintaining that temperature. After the methanol is evaporated, the solution is cooled, and distilled water is added to achieve a total weight of 51 g (the distilled water is replenished because water also evaporates when evaporating the methanol). Thereafter, the solution is centrifuged and solid matter is removed via filtration using a 0.3 μm mesh filter, and the surface tension of the obtained aqueous impurity extract liquid may then be measured.

The method of washing the particles is not specifically limited insofar as the method produces the toner having the previously described characteristics. Examples of effective washing methods include washing methods wherein the microparticles using an adequate amount of water after wet-type granulation, and washing methods wherein the filtration process is repeated, then the filtration process is repeated after mixing for a fixed time in warm water.

More specifically, it is desirable that an adequate amount of distilled water or ion-exchanged water is used as the washing water. For example, decantation will be performed more than once, and desirably more than twice using an adequate amount of water, i.e., 1 liter or more, and desirably 2 liters or more relative to approximately 80 g microparticles after the particles are converted to dry particles following wet-type granulation, then the washing/filtration process using sufficient water is repeated 3 or more times, and desirably 5 or more times. When ionic dispersant, and particularly anionic dispersant is used, the washing is desirably accomplished by repeating the mixing/filtration process more than once, and desirably more than twice, using warm water, for example, warm water of 40° C. or greater, and desirably approximately 50° C.

When a nonionic organic dispersing agent such as polyvinyl alcohol or carboxymethyl cellulose is used as a dispersant during wet-type granulation, be certain that washing is accomplished via ultrasonic mixing in a sufficient amount of a mixed water solution containing 20% by weight or more, and desirably 30% by weight or more, alcohol such as methanol, ethanol or the like. When an anionic organic dispersing agent such as polyacrylate or the like is used, this process is not always necessary. It is desirable that washing using this mixed water solution is accomplished when using a dispersant having a small HLB value using the certain HLB value (i.e., the cardinal number of the hydrophilic group) of the polyvinyl alcohol as a standard.

After drying the particles washed in the manner described above, the particles may be subjected to a classification process as necessary to obtain a toner for developing an electrostatic latent image wherein the toner particles have an average particle size of 2 to 15 μm, and desirably 4 to 10 μm.

Fluidizing agents and cleaning agents may be added to the toner produced by the method of the present invention. Examples of useful fluidizing agents include inorganic particles such as silica, alumina, titania, zinc oxide, iron oxide, copper oxide, lead oxide, antimony oxide, yttrium oxide, magnesium oxide, barium titanate, ferrite, red oxide, magnesium fluoride, silicon carbide, boron carbide, silicon nitride, zirconium nitride, magnetite, magnesium stearate and the like. These inorganic particles may be subjected to surface processing to improve dispersibility on the surface of the toner particles, and improve environmental stability. The surface processing agent may be silane coupling agent, titanium coupling agent higher fatty acids, silicone oil and the like. Examples of useful cleaning agents include polystyrene particles, polymethylmethacrylate particles and the like. The fluidizing agent and cleaning agent are added at 0.1 to 20 parts-by-weight relative to 100 parts-by-weight of toner particles.

The toner produced by the method of the present invention is usable as a monocomponent developer which does not use a carrier, or a two-component developer which does use a carrier.

EXAMPLE 1

To a 2 liter plastic bottle were introduced 200 g polyester resin (Mn: 4200, Mw: 14000, Mw/Mn: 3.3, Tg: 60° C.), 12 g phthalocyanine pigment, 4 g BONTRON E-84™ (Orient Chemical Industries, Ltd.) as a charge controller, and 800 g toluene, and the materials were mixed for 30 min using an ULTRA TURRAX (IKA, Inc.), and after dispersion the material was further mixed for 30 min at 60 Hz using an Eiger motormill (Eiger Japan) to obtain a uniformly mixed dispersion fluid. A dispersion medium was prepared by dissolving 30 g sodium polyacrylate (Wako Pure Chemical Industries, Ltd.; average degree of polymerization n=2700 to 7500) as a dispersant, and 1 g alkyldiphenyl ether sodium disulfonate as a dispersion-aiding agent in 1,000 g ion-exchanged water. To a 3 liter round-bottom stainless steel container was added 1,000 g of this dispersion medium, and 400 g of the mixed dispersion fluid were gradually titrated for approximately 10 min using a 20 cc dropper while mixing at 4,000 rpm using a TK homomixer (Tokushukika Kogyo Co., LTD.). After the mixed dispersion fluid was completely introduced, mixing continued for 10 min to accomplish emulsification. Thereafter, the toluene was removed under conditions of 50 to 55° C. and 140 to 70 mmHg, the solution was cooled, ion-exchanged water was added to attain a total solution amount of 2 liters, and the solution was decanted twice in a 5 liter-beaker. After performing the washing/filtration process 5 times at room temperature, the material was mixed for about 1 hr in 50° C. ion-exchange water, then filtered. This process was repeated twice.

The washed toner cake was mixed in 1 liter of 50 wt % methanol-water solution to obtain a uniform slurry, which was then dried at a temperature of 100° C. using a spray drying device (DISPACOAT; Nissei Engineering, Ltd.) to obtain toner particles.

EXAMPLE 2

Toner particles were produced in the same manner as in example 1 with the exception that sodium polyacrylate A-20UK™ (Toagosei Chemical Industry Co., Ltd.) was substituted for the dispersant, i.e., sodium polyacrylate, used in example 1.

EXAMPLE 3

Toner particles were produced in the same manner as in example 1 with the exception that sodium acrylate-malate copolymer A6330™ (Toagosei Chemical Industry Co., Ltd.; weight-average molecular weight: 20,000) was used as a dispersant.

EXAMPLE 4

Toner particles were produced in the same manner as in example 1 with the exception that sodium polymethacrylate (Aldrich, Inc.; weight-average molecular weight: 9500) was used as a dispersant.

EXAMPLE 5

Toner particles were produced in the same manner as in example 1 with the exception that PVA PA-18™ (polyvinyl alcohol; Shin-Etsu Chemical Co., Ltd.) was substituted for the dispersant, i.e., sodium polyacrylate, used in example 1, and after the wash/filtration process, the material subjected to ultrasonic mixing with 50 wt % methanol-water solution for approximately 1 hr until cooled to under 30° C., then filtered, and this process was repeated twice.

EXAMPLE 6

Toner particles were produced in the same manner as in example 1 with the exception that PVA PA-05™ (polyvinyl alcohol; Shin-Etsu Chemical Co., Ltd.) was substituted for the dispersant, i.e., sodium polyacrylate, used in example 1, and after the wash/filtration process, the material subjected to ultrasonic mixing with 50 wt % methanol-water solution for approximately 1 hr until cooled to under 30° C., then filtered, and this process was repeated twice.

EXAMPLE 7

Toner particles were produced in the same manner as in example 1 with the exception that PVA SMR-10H™ (polyvinyl alcohol; Shin-Etsu Chemical Co., Ltd.) was substituted for the dispersant, i.e., sodium polyacrylate, used in example 1, and after the wash/filtration process, the material subjected to ultrasonic mixing with 50 wt % methanol-water solution for approximately 1 hr until cooled to under 30° C., then filtered, and this process was repeated twice.

Comparative Example 1

To a 2 liter plastic bottle were introduced 200 g polyester resin (Mn: 4200, Mw: 14000, Mw/Mn: 3.3, Tg: 60° C.), 12 g phthalocyanine pigment, 4 g BONTRON E-84™ (Orient Chemical Industries, Ltd.) as a charge controller, and 800 g toluene, and the materials were mixed for 30 min using an ULTRA TURRAX (IKA, Inc.), and after dispersion the material was further mixed for 30 min at 60 Hz using an Eiger motormill (Eiger Japan) to obtain a uniformly mixed dispersion fluid. A dispersion medium was prepared by dissolving 30 g sodium polyacrylate (Wako Pure Chemical Industries, Ltd.; average degree of polymerization n=2700 to 7500) as a dispersant, and 1 g alkyldiphenyl ether sodium disulfonate as a dispersion-aiding agent in 1,000 g ion-exchanged water. To a 3 liter round-bottom stainless steel container was added 1,000 g of this dispersion medium, and 400 g of the mixed dispersion fluid were gradually titrated for approximately 10 min using a 20 cc dropper while mixing at 4,000 rpm using a TK homomixer (Tokushukika Kogyo Co., LTD). After the mixed dispersion fluid was completely introduced, mixing continued for 10 min to accomplish emulsification. Thereafter, the toluene was removed under conditions of 50 to 55° C. and 140 to 70 mmHg, the solution was cooled, ion-exchanged water was added to attain a total solution amount of 2 liters, and the solution was decanted twice in a 5 liter beaker. After performing the washing/filtration process using 2 liters of ion-exchanged water at room temperature, the material was mixed in 1 liter of 50% by weight methanol-water solution to obtain a uniform slurry, which was then dried at a temperature of 100° C. using a spray drying device (DISPACOAT; Nissei Engineering, Ltd.) to obtain toner particles.

Comparative Example 2

Toner particles were produced in the same manner as in example 5 with the exception that washing was accomplished at room temperature rather than using ion-exchanged water at 50° C.

Compartive Example 3

Toner particles were produced in the same manner as in example 5 with the exception that ultrasonic washing using 50% by weight methanol-water solution was not performed.

Measuring Surface Tension

One gram of the obtained toner particles were added to 50 g distilled water and mixed for 1 hr at 80° C. The obtained solution was cooled, then centrifuged, and solid matter was removed via filtration using a 0.3 $\mu$m mesh filter to obtain an aqueous impurity extract liquid. The surface tension of the obtained extract liquid was measured at 25° C. via a plate method using a model CBVP-Z device (Kyowa Interface Science Co., LTD.).

Carrier Manufacture

Carrier was produced by the method described below.

A mixture of 80 pbw styrene-acrylic copolymer comprising styrene, methylacrylate, 2-hydroxyethylacrylate, and methacrylate (1.5:7:1.0:0.5) and 20 pbw butylated melamine resin was diluted with toluene to produce a styrene-acrylic resin solution having a solid ratio of 20 wt %.

This styrene-acrylic resin solution was used to coat a calcined ferrite core (F-300; average particle size: 50 $\mu$m, high density: 2.53 g/cm3; Powder Tech, Inc.) using a SPIRA COTA (Okada Seiko K.K.), then dried. The obtained carrier was stored at 140° C. for 2 hr in an oven with internal air circulation to accomplish calcination. After cooling, the bulk ferrite powder was cracked using a sieve shaker provided with mounted screen meshes of 210 $\mu$m and 90 Um pore sizes to obtain resin-coated ferrite powder. This resin-coated ferrite powder was subjected to the coating, calcination, and cracking processes 3 times to obtain the resin-coated carrier.

The obtained carrier has an average particle size of 52 $\mu$m, and electrical resistance of approximately $3\times10^{10}$ Ωcm.

Measuring Amount of Electrical Charge

The obtained toner and carrier were mixed at a weight ratio of 5:95 to produce a developer for use in evaluation. To a 50 cc capacity polyethylene bottle were added 30 g of developer, and the material was mixed for 90 min at 1200 rpm. The amount of toner charge was determined by brining the toner into contact with a film previously charged to a predetermined charge amount, and measuring the quantity of toner adhered to the film. This measurement was accomplished at normal temperature and normal humidity (25° C., 60% RH).

Amount of Charge at High Temperature, High Humidity MHH))

The evaluation developer stored under conditions of high temperature and high humidity (30° C., 85% RH) for 24 hr prior to mixing, and the aforesaid measurement was performed in a high temperature, high humidity environment.

Reverse Charge Toner

The obtained toner and carrier were mixed at a weight ratio of 5:95 to produce a developer. To a 50 ml capacity polyethylene bottle were added 30 g of developer, and the material was mixed for 90 min at 1200 rpm. One gram of this developer was loaded on a magnet roller 310 mm in diameter. Then, a precisely weighed opposed electrode was set, a 1 kV bias voltage of a polarity opposite the polarity of the toner was applied, and the magnetic roller was rotated for 1 min at 1000 rpm. Then, the opposed electrode was again precisely weighed, and the amount of separated toner adhered to the opposed electrode, i.e., the amount of inadequately charged toner, was calculated from the difference in the initial weight and the final weight of the opposed electrode.

Measurement results are shown in Table 1 below.

TABLE 1

| | Charge (μC/g) | H/H Charge (μC/g) | Reverse Charge Toner (% by weight) | Surface Tension (mN/m) |
|---|---|---|---|---|
| Ex. 1 | −30.0 | −30.3 | 0.0 | 67.8 |
| Ex. 2 | −26.4 | −23.7 | 0.1 | 60.2 |
| Ex. 3 | −26.1 | −23.2 | 0.1 | 58.3 |
| Ex. 4 | −28.2 | −26.0 | 0.2 | 61.2 |
| Ex. 5 | −24.3 | −20.1 | 0.6 | 51.0 |
| Ex. 6 | −24.8 | −20.8 | 0.5 | 52.4 |
| Ex. 7 | −25.3 | −21.2 | 0.4 | 53.8 |
| Comp Ex. 1 | −22.8 | −10.8 | 5.2 | 48.5 |
| Comp Ex. 2 | −15.6 | −2.3 | 20.6 | 38.7 |
| Comp Ex. 3 | −18.2 | −2.0 | 14.8 | 39.2 |

As the results listed in Table 1 clearly show, the toner of the examples have adequate charge amounts, only very small amounts of reverse charge toner, and only very slight change in chargeability after storage under high temperature, high humidity conditions. Conversely, the toner of the comparative examples exhibited worsened chargeability after storage under high temperature and high humidity conditions, including reduced charge amount and an increase in the amount of reverse charge toner. In particular, the toner of the comparative examples 1~3 did not provide adequate charge amount even when not stored under high temperature and high humidity conditions, and there was also a large amount of reverse charge toner; chargeability markedly deteriorated after storage under high temperature and high humidity conditions.

Although the present invention has been fully described by way of examples with reference to the accompanying drawings, it is to be noted that various changes and modification will be apparent to those skilled in the art.

Therefore, unless otherwise such changes and modifications depart from the scope of the present invention, they should be construed as being included therein.

What is claimed is:

1. A method of manufactring toner comprising:

emulsifying a binder resin, a colorant and a non water-soluble organic solvent in an aqueous liquid medium containing an organic dispersing agent so as to form an oil-in-water emulsion;

removing the non water-soluble organic solvent from droplets of the emulsion so as to form colored resin particles; and obtaining toner by adjusting a surface tension of an aqueous extract liquid to a range of 50 to 72 mN/m at 25° C. by removing the organic dispersing agent from the colored resin particles, the aqueous extract liquid obtained by mixing 1 part-by-weight the colored resin particles and 50 parts-by-weight distilled water for 1 hour at 80° C.

2. The method of claim 1, wherein the organic dispersing agent is at least one selected from the group consisting of a nonionic organic dispersing agent, an anionic organic dispersing agent and a cationic organic dispersing agent.

3. The method of claim 2, wherein the organic dispersing agent is at least one selected from the group consisting of a nonionic organic dispersing agent and an anionic organic dispersing agent.

4. The method of claim 1, wherein an amount of the organic dispersing agent is 1 to 10% by weight relative to the aqueous liquid medium.

5. The method of claim 1, wherein the binder resin has a glass transition temperature of 50 to 70° C., a number-average molecular weight of 1000 to 50000 and a weight-average molecular weight/number-average molecular weight of 2 to 60.

6. The method of claim 5, wherein the binder resin has the weight-average molecular weight/number-average molecular weight of 2 to 5.

7. The method of claim 5, wherein the binder resin has the weight-average molecular weight/number-average molecular weight of 20 to 50.

8. The method of claim 1, wherein removing the organic dispersing agent from the colored resin particles comprises washing the colored resin particles.

9. The method of claim 1, wherein removing the organic dispersing agent from the colored resin particles comprises washing and filtering the colored resin particles.

10. A method of manufacturing toner comprising:

suspending a polymerizable monomer, a polymerization initiator and a colorant in an aqueous liquid medium containing an organic dispersing agent so as to form a suspension;

polymerizing the monomer so as to form colored resin particles; and obtaining toner by adjusting a surface tension of an aqueous extract liquid to a range of 50 to 72 mN/m at 25° C. by removing the organic dispersing agent from the colored resin particles, the aqueous extract liquid obtained by mixing 1 part-by-weight the colored resin particles and 50 parts-by-weight distilled water for 1 hour at 80° C.

11. The method of claim 10, wherein the organic dispersing agent is at least one selected from the group consisting of a nonionic organic dispersing agent, an anionic organic dispersing agent and a cationic organic dispersing agent.

12. The method of claim 11, wherein the organic dispersing agent is at least one selected from the group consisting of a nonionic organic dispersing agent and an anionic organic dispersing agent.

13. The method of claim 10, wherein an amount of the organic dispersing agent is 1 to 10% by weight relative to the aqueous liquid medium.

14. The method of claim 10, wherein a binder resin included the colored resin particles has a glass transition temperature of 50 to 70° C., a number-average molecular weight of 1000 to 50000 and a weight-average molecular weight/number-average molecular weight of 2 to 60.

15. The method of claim 14, wherein the binder resin has the weight-average molecular weight/number-average molecular weight of 2 to 5.

16. The method of claim 14, wherein the binder resin has the weight-average molecular weight/number-average molecular weight of 20 to 50.

17. The method of claim 10, wherein removing the organic dispersing agent from the colored resin particles comprises washing the colored resin particles.

18. The method of claim 10, wherein removing the organic dispersing agent from the colored resin particles comprises washing and filtering the colored resin particles.

* * * * *